US005462238A

United States Patent [19]

Smith et al.

[11] Patent Number: 5,462,238

[45] Date of Patent: Oct. 31, 1995

[54] APPARATUS AND METHOD FOR SHREDDING INSULATION

[75] Inventors: Donald K. Smith; Stephen J. Haddix; Randall J. Blomquist, all of Bend, Oreg.

[73] Assignees: Guaranteed Baffle Co., Inc.; Norpac GSE, both of Bend, Oreg.

[21] Appl. No.: 388,163

[22] Filed: Feb. 9, 1995

Related U.S. Application Data

[63] Continuation of Ser. No. 210,515, Mar. 17, 1994, abandoned.

[51] Int. Cl.[6] ..... B02C 18/18; B02C 18/22

[52] U.S. Cl. ..... 241/243; 241/247; 241/292.1; 241/DIG. 38

[58] Field of Search ..... 241/30, 243, 247, 241/260.1, DIG. 38, 292.1

[56] References Cited

U.S. PATENT DOCUMENTS

| | | | |
|---|---|---|---|
| 187 | 1/1858 | MacKerley | 241/261 |
| 1,916,192 | 7/1933 | David | 241/292.1 |
| 2,903,192 | 9/1959 | Clausen | 241/247 |
| 4,168,035 | 9/1979 | Palm et al. | 241/81 |
| 4,465,239 | 8/1984 | Woten | 241/98 |
| 4,678,126 | 7/1987 | Prentice et al. | 241/34 |
| 4,881,690 | 11/1989 | Maier | 241/82.3 |
| 5,135,310 | 8/1992 | Nodus et al. | 366/297 |
| 5,148,999 | 9/1992 | Curfman et al. | 241/260.1 |
| 5,253,815 | 10/1993 | Bowns et al. | 241/186.1 |
| 5,277,371 | 1/1994 | Bowns et al. | 241/154 |
| 5,289,978 | 3/1994 | Lundquist | 241/57 |
| 5,368,238 | 11/1994 | Bergkamp et al. | 241/30 |
| 5,402,950 | 4/1995 | Blair et al. | 241/101.7 |

FOREIGN PATENT DOCUMENTS

| | | | |
|---|---|---|---|
| 9000586 | 10/1990 | Netherlands | 241/292.1 |

*Primary Examiner*—Mark Rosenbaum
*Assistant Examiner*—John M. Husar
*Attorney, Agent, or Firm*—Klarquist Sparkman Campbell Leigh & Whinston

[57] ABSTRACT

The shredding apparatus comprises a shredder housing with an inlet having a flow regulator that feeds insulation into the housing at a selected rate. A blade assembly is positioned within the housing adjacent the inlet. The blade assembly rotates about an axis designating an insulation flow direction. The blade assembly has a plurality of knife blades that are arranged in a helix about the axis, and are operable to catch insulation fed from the flow regulator. A stator positioned adjacent the blade assembly obstructs the insulation caught on the blade assembly such that the blade assembly shreds the insulation. The blade assembly urges the shredded insulation to an auger positioned coaxially with the blade assembly that discharges the shredded insulation from the housing.

2 Claims, 4 Drawing Sheets

APPARATUS AND METHOD FOR SHREDDING INSULATION

This application is a continuation, of application Ser. No. 08/210,515, filed on Mar. 17, 1994, now abandoned.

FIELD OF THE INVENTION

The present invention relates to an apparatus and method for shredding insulation, and more particularly, to an apparatus and method for shredding insulation into small pieces that may be blown into wall cavities and the like.

BACKGROUND OF THE INVENTION

Insulation is often produced in sheets that are rolled and shipped to a building construction site or the like. At the construction site, the sheets are unrolled and trimmed for installation into building wall and ceiling cavities. Such trimming produces large amounts of scrap insulation that is often discarded and dumped into landfills.

In spite of the inherent waste and expense of discarding scrap insulation, there has been no practical way to recycle such scrap insulation. For instance, existing machines for shredding insulation into small pieces for use as "blow-in" insulation have not previously proved adaptable to the recycling of scrap insulation.

Such existing shredding machines are expensive, high-volume machines designed only for producing blow-in insulation in insulation factories. One such a shredder uses a chain assembly to shred entire insulation sheets that are laid out flat. Another shredder has a large drum with cookie-cutter-type blades that rolls over entire laid-out sheets of insulation to cut the insulation into pieces.

Because of the expensive, high-volume design, such factory shredding machines are uneconomical to apply to sporadic recycling use. Moreover, factory shredding machines tend to be large and not easily transportable.

SUMMARY OF THE INVENTION

The present invention is directed to an improved apparatus and method for shredding insulation. It is an object of the present invention to provide an insulation shredding apparatus for generating blow-in insulation from scrap insulation.

An additional object of the present invention to provide an insulation shredding apparatus that is compact for mobility to and around a reprocessing site.

A further object of the invention is to provide an insulation shredding method and apparatus that is inexpensive.

Another object of the invention is to provide an insulation shredding apparatus that accepts a wide range of insulation scrap sizes.

Yet another object of the invention is to provide an insulation shredding apparatus and method capable of packaging the shredded insulation.

A preferred apparatus for shredding insulation comprises a housing with an insulation inlet. A blade assembly is positioned within the housing adjacent the inlet. The blade assembly rotates about an axis defining an insulation flow direction. The blade assembly has a plurality of knife blades that are arranged in a helix about the axis and are operable to catch insulation inserted through the inlet. An obstruction member is connected to the housing adjacent the blade assembly. The obstruction member obstructs the insulation caught on the rotating blade assembly so that the knife blades shred the insulation. The helical arrangement of the knife blades urges shredded insulation along the flow direction.

The shredding apparatus may also include an inlet flow regulator that feeds the insulation into the housing at a selected rate, and an auger positioned within the housing coaxial with the blade assembly to receive shredded insulation from the blade assembly and to discharge the shredded insulation from the apparatus.

A preferred method of the invention includes feeding insulation scraps toward a rotating blade assembly, catching the fed insulation with the blade assembly, obstructing the insulation caught on the rotating blade assembly so that the blade assembly shreds the insulation, and urging the shredded insulation along a horizontal flow axis.

The foregoing additional features and advantages of the present invention will be more readily apparent from the following detailed description, which proceeds with reference to the accompanying drawings.

DESCRIPTION OF A PREFERRED EMBODIMENT

Figure 1:
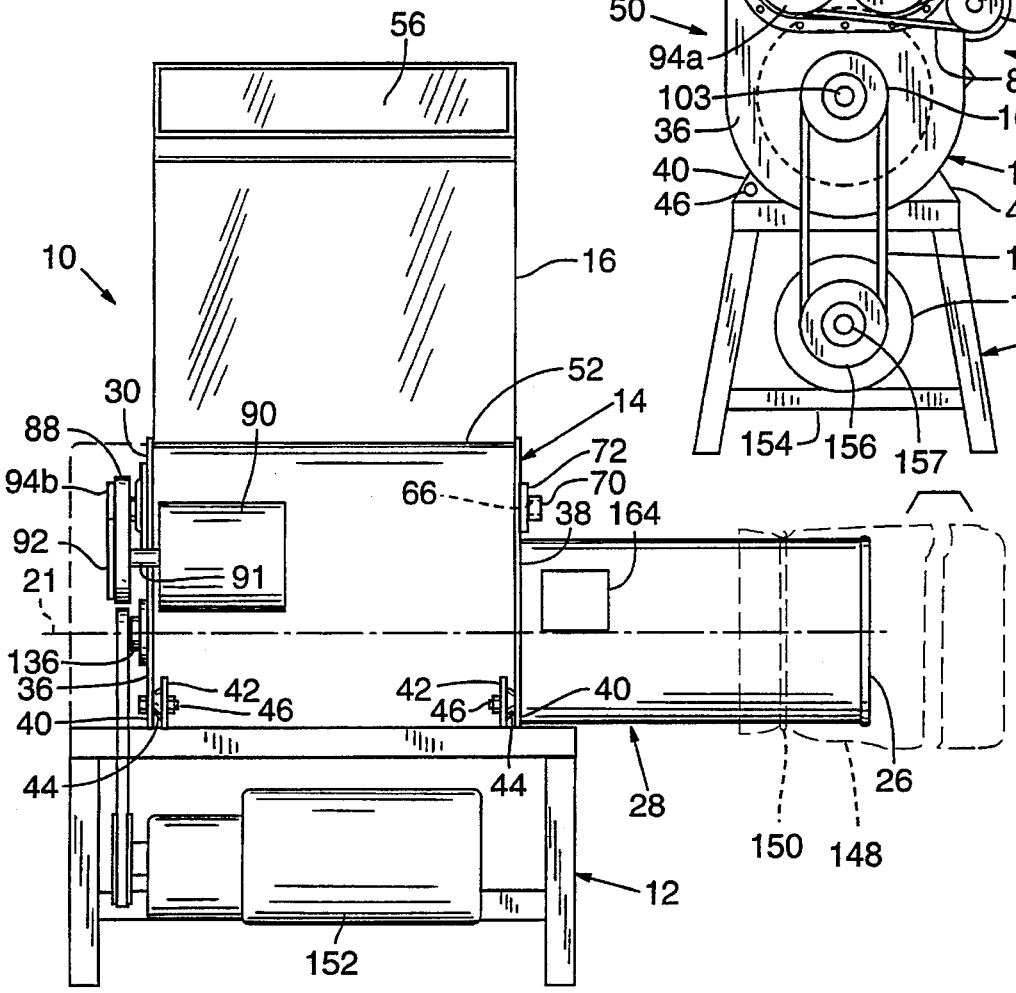
FIG. 1 is a front view of an insulation shredder apparatus of the present invention, with a guard for covering the pulleys and belts removed.

An insulation shredding apparatus in accordance with a preferred embodiment of the present invention is designated in FIG. 1 with reference numeral 10. The shredding apparatus generally includes a housing 14 supported on a frame 12, with a feed hopper 16 mounted upon the housing 14. In operation, insulation to be shredded is fed into the feed hopper 16 defining a chute into the machine. The insulation drops through the bottom of the feed hopper into a dual-roller feed regulator 18 (see FIGS. 2 and 4). The feed regulator 18 feeds the insulation at a preselected rate toward a blade assembly 20 that rotates about a horizontal axis 21 within the housing 14.

Figure 3:
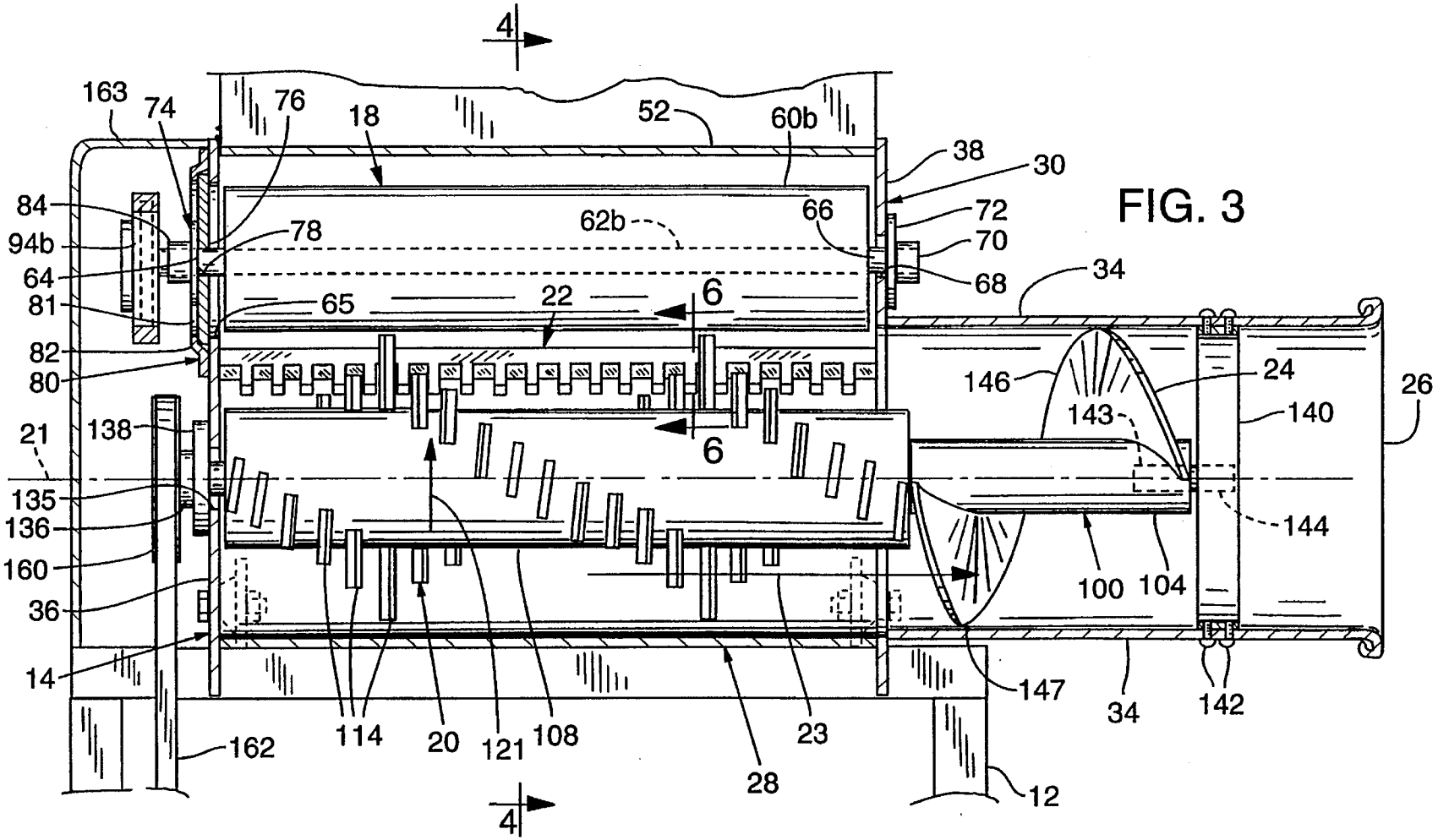
FIG. 3 is a cutaway, partial cross-sectional front view of the insulation shredding apparatus of the present invention, showing interior components of the apparatus.

The blade assembly 20 catches the insulation and rotates the insulation to a stator 22 (obstruction member). The stator has fixed teeth interdigitated with the rotor blades to provide cross-combing action causing the blade assembly 20 to shred the insulation. As shown in FIG. 3, as the blade assembly 20 rotates, it progressively urges the shredded insulation in a flow direction 23 parallel to axis 21 toward an auger 24. The auger 24 rotates coaxially with the blade assembly 20 and moves the insulation in the flow direction 23 to discharge the insulation through an insulation outlet 26 in the housing 14.

As shown in FIG. 3, the housing 14 has a lower cylindrical housing portion 28 and an upper feed portion 30. The cylindrical housing 28 is an elongate tube that closely houses the blade assembly 20 and auger 24. The cylindrical housing 28 is positioned on top of the support frame 12 such that the portion housing the auger 24 is substantially cantilevered from the frame 12. The housing upper feed portion 30 encloses the feed regulator 18, which is positioned directly above the blade assembly 20.

Figure 2:
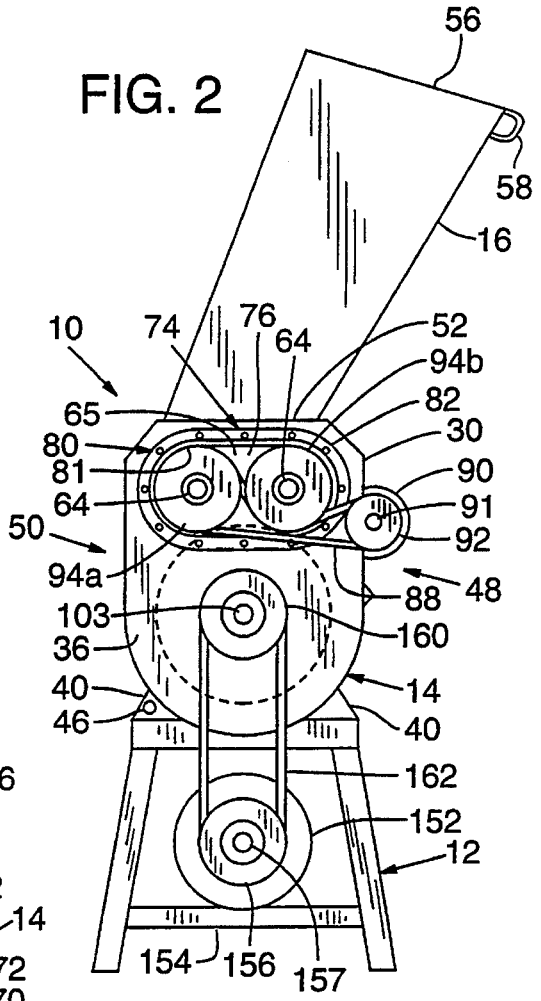
FIG. 2 is an end view of the insulation shredding apparatus of FIG. 1, with interior components shown in dashed lines.

One end of the housing 14 is defined by a first end plate 36 that encloses a first end of the feed portion 30 and the cylindrical housing 28. A second end plate 38 encloses the opposite second end of the feed portion 30, and has a circular aperture on a lower portion thereof. The aperture permits passage of material from the rotor to the auger, and frames the cylindrical housing 28 near the intersection of the blade assembly 20 and auger 24. As shown in FIGS. 1 and 2, the first and second end plates 36, 38 each have a pair of attachment flanges 40 for attaching the housing to the frame 12. The attachment flanges 40 extend from the underside of the cylindrical housing 28. The attachment flanges 40 have bolt holes that align with bolt holes on respective pairs of attachment plates 42 that extend vertically from the frame 12. To minimize apparatus vibration, resilient washers 44 are sandwiched between the attachment flanges 40 and the attachment plates 42. Attachment bolts 46 are received through the bolt holes and washers 44.

As shown in FIG. 2, the frame 12 and housing 14 together define a front side 48 and a back side 50 of the shredding apparatus 10. To increase the mobility of the shredding apparatus, the frame 12 may be equipped with wheels (not shown).

As shown in FIG. 2, the hopper 16 extends upwardly from an upper side 52 of the housing feed portion 30. The hopper 16 is tilted from the vertical toward the front side 48 of the apparatus 10. The hopper is upwardly flared, with a rectangular cross-section that gradually widens with elevation to a top rectangular feed opening 56. The feed opening 56 is conveniently positioned about six feet above the ground level and is large enough to receive varying sizes of scrap insulation. The front edge of the feed opening 56 has a smooth, downwardly curved lip 58 to prevent insulation from snagging when fed into the hopper. The hopper 16 may be spot-welded or attached with fasteners or other means to the housing.

Figure 4:
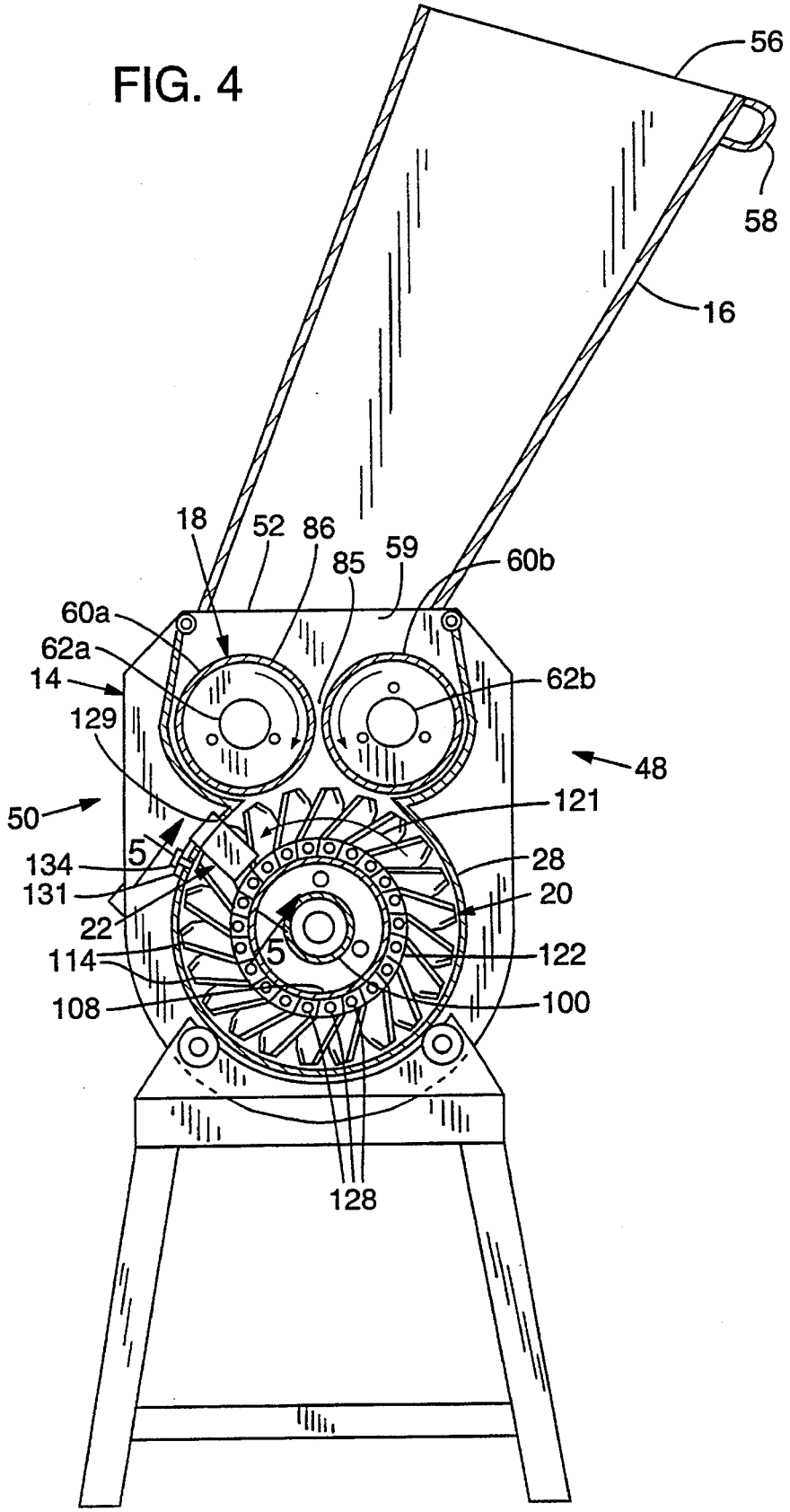
FIG. 4 is a sectional view generally taken along line 4—4 of FIG. 3.

Insulation scraps placed in the hopper 16 enter the housing through a feed opening 59 where the lower end of the hopper meets the upper side 52 of the housing (see FIG. 4). The feed regulator 18 is positioned directly below the feed opening 59 and comprises two parallel, elongate rollers 60a, 60b that extend parallel with the axis 21. The rollers counter-rotate to draw the insulation between them, and thereby to feed insulation into the cylindrical housing 28 at a predetermined rate. The rollers 60*a*, 60*b* include central shafts 62*a*, 62*b* with first and second shaft ends 64, 66 that extend from the opposite ends of the rollers.

A large opening 65 defined in the housing first end plate 36 (see FIG. 2) receives the rollers 60*a*, 60*b*. As shown in FIG. 3, the second end 66 of each shaft is received in a shaft aperture 68 defined in the housing second end plate 38. A bearing ring 70 rotatably supports the second shaft end 66 within the shaft aperture. The bearing ring 70 has a peripheral attachment flange 72 that is bolted to the exterior of the second end plate 38, and an inner bearing surface to permit the smooth rotation of the shafts 60*a*, 60*b*.

The first shaft ends 64 are secured by a flange plate assembly 74 (see FIGS. 2 and 3). The flange plate assembly includes a plate 76 defining a pair of shaft apertures 78, each of which receives the first end 64 of a respective one of the shafts. The plate 76 is secured to the exterior of the first end plate 36 by a flange plate 80. The flange plate 80 has an inner flange 81 that cradles the periphery of the plate 76. Flange plate 80 has an outer peripheral attachment flange 82 that is bolted to the exterior of the first end plate 36 to secure the entire flange plate assembly 74 thereto. Bearing rings 84, which may be identical to bearing rings 70, receive the shaft first ends 64 and are bolted onto the plate 76 to rotatably secure the first shaft ends 64.

As best seen in FIG. 4, the rollers 60*a*, 60*b* are separated by approximately a one-inch gap 85. The rollers preferably have a rubber outer layer 86 with a coefficient of friction that effectively grips the insulation in the hopper 16 and pulls the insulation into compression through the counter-rotating rollers 60*a*, 60*b*. It is to be understood that a variety of roller coatings that effectively grip may work equally as well.

As best shown in FIG. 2, the rollers 60*a*, 60*b* are driven by a single feed chain 88. The feed chain 88 is driven by a feed motor 90 that is mounted on the front side 48 of the housing 14. A horizontal driveshaft 91 extends from the feed motor and rotatably supports a feed pulley 92 in a vertical plane spaced outward and adjacent from the first end plate 36. Roller pulleys 94*a*, 94*b* are mounted on the shaft first ends 64 in planar registration with the feed pulley 92. The feed chain 88 extends from the underside of the feed pulley 92 to the underside of the first roller pulley 94*a* (adjacent the apparatus' back side 50). The feed chain 88 loops around the first roller pulley 94*a*, crosses between the roller pulleys, loops around the underside of second roller pulley 94*b*, and crosses to the upper side of the feed pulley 92. As the feed chain 88 runs in the direction from the feed pulley 92 to the first roller pulley 94*a*, the first and second roller pulleys 94*a*, 94*b* inwardly counter-rotate.

As shown in FIGS. 3 and 4, a rotatable driveshaft 100 extends along axis 21 through the center of the cylindrical portion 28 of the housing. The driveshaft 100 carries the blade assembly 20 adjacent a shaft first end 103 (directly below the feed regulator 18 see FIG. 2) and carries the auger 24 adjacent a shaft second end 104 (see FIG. 3). The blade assembly 20 includes a cylindrical blade tube 108 concentrically mounted over the driveshaft 100. The blade tube 108 supports a series of knife blades 114. The blade tube 108 is preferably rigidly welded to the driveshaft 100 at end disk plates 112 (see FIG. 5). The blade tube 108 may alternatively be mounted to the driveshaft 100 by bolts or other fasteners.

Figure 5:
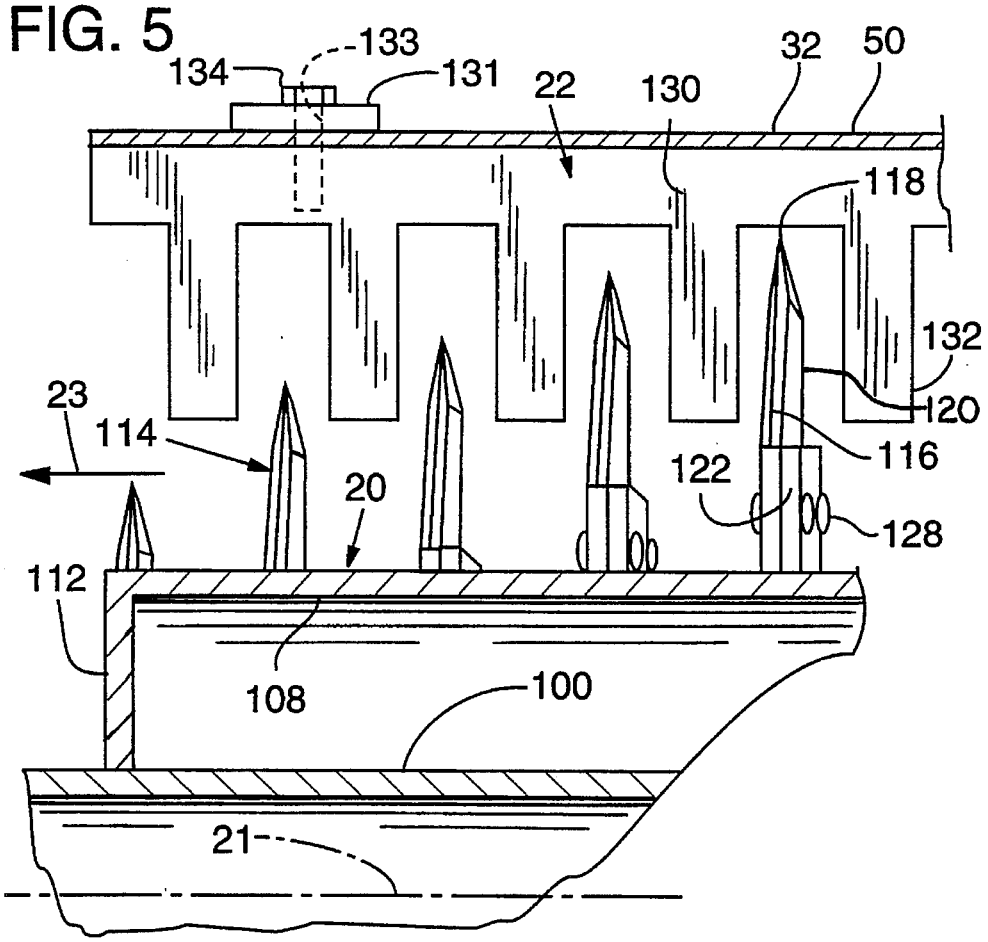
FIG. 5 is an enlarged cross-sectional view generally taken along line 5—5 of FIG. 4.
Figure 6:
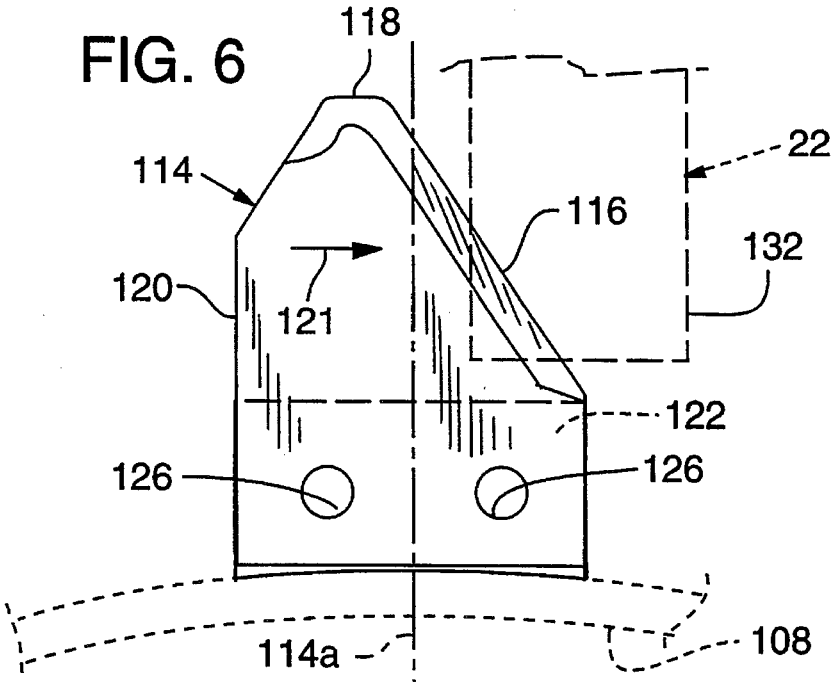
FIG. 6 is an enlarged cutaway view taken along line 6—6 of FIG. 3.

As shown in FIGS. 3 and 4, the series of knife blades 114 are preferably arranged in a double helical pattern along the blade tube 108. The blades 114 project radially from the blade tube 108 and catch the insulation fed through the feed regulator 18. As best shown in FIGS. 5 and 6, the blades are planar elements, each with a leading sharpened cutting edge 116, a sharpened distal edge 118, and a trailing edge 120. Preferably, the blades 114 are each offset about ten degrees from the perpendicular to the axis 21, such that the cutting edges 116 are positioned relatively further in the flow direction 23 than are the blade trailing edges 120 i.e., blades 114 are each rotated about ten degrees about a radial line 114(a) drawn from axis 21 through each blade. In the illustrated embodiment, blades 114 are rotated clockwise inasmuch as blade tube 108 is itself rotated counterclockwise. Clockwise is defined as when looking inwardly from distal edge 118 along radial line 114*a* towards axis 21. See FIGS. 3, 5 and 6. Such a blade offset angle slows the flow of insulation through the blade assembly 20. In general, the greater the offset, the slower the insulation flow rate.

As shown in FIGS. 4, 5 and 6 the blade tube 108 has blade attachment plates 122 for mounting the blades 114. The blade attachment plates 122 extend radially from the blade tube, and each has a pair of bolt holes 126 that align with a corresponding pair of bolt holes in each blade (see FIG. 6). Pairs of bolts 128 (see FIG. 5) secure the blades 114 to the attachment plates 122. The attachment plates 122 are preferably welded to the blade tube 108 and are offset as described above to offset the blades 114.

The blade assembly 20 rotates in a direction shown by directional arrow 121 in FIGS. 3, 4 and 6. The rotation of the blade assembly rotates each blade 114 through a circular path. The rotating double helical pattern of blades 114 urges insulation to flow in the flow direction 23 (see FIG. 3), in spite of the contrary forces generated by the angled blades. A narrow gap 119 separates the blade distal edges 118 and the interior of the cylindrical housing 28 so that the helical blade arrangement urges the insulation in an auger-like action along flow direction 23. To increase the insulation flow rate, the blade offset angle could be reversed such that the cutting edges are offset behind the trailing edges (not shown). The blades set in such a reverse offset angle together are contoured more like a true helical auger, and so increase the flow speed of the insulation.

As shown in FIGS. 3 and 4, the stator 22 is positioned within the housing adjacent the blade assembly 20. The stator 22 obstructs the insulation caught on the rotating blade assembly 20 so that the blade assembly shreds the insulation. As seen in detail in FIG. 5, the stator has a body 130 that extends parallel with the axis 21 along the blade assembly. The stator 22 is positioned adjacent an upper portion of the blade assembly 20, on the side of the blade assembly where the blades are rotating downwardly (see directional arrow 121 in FIG. 4). As shown in FIG. 5, the stator body 130 is closely spaced from the blade top edges 118, and has block-like stator fingers or extensions 132 that are interdigitated with the blade assembly blades 114. Both the stator body 130 and stator fingers 132 obstruct the insulation caught on the blade assembly 20 so that the blade assembly shreds the insulation in a cross-combing action.

While the stator fingers 132 are block-like in the preferred embodiment, the extensions could also be sharpened to contribute to the cross-combing shredding of insulation.

As shown in FIG. 4, the stator 22 is mounted through an elongate slot 129 in an upper part of the back side 50 of the cylindrical housing 28. The elongate stator body 130 snugly fits within the slot. The stator 22 has three stator flanges 131 for mounting the stator to the housing (one of which is shown in FIGS. 4 and 5). The stator flanges 131 extend downwardly from the stator body 130. Each flange 131 has a single bolt hole 133 that aligns with a threaded hole in the cylindrical housing 28. A stator bolt 134 is received in the aligned holes to secure the stator 22 in position.

The shredding apparatus 10 of the present invention is configured to permit repeated shredding of a given scrap of insulation before the insulation enters the auger 24. After the insulation is shredded at the junction of the stator 22 and blade assembly 20, the insulation may fall off the blade assembly 20 into a lower portion of the cylindrical housing 28. Such shredded insulation may be recaught by the blade assembly 20 and rotated upward to the stator 22 for reshredding. The preferred offset of the blade assembly blades 114, as discussed above, contributes to the repeated shredding of insulation by slowing the flow rate of insulation through the blade assembly 20.

Alternatively, insulation may cling to the blades 114 after the insulation has been shredded at the stator 22. In this case, the shredded insulation moves with the blade 114 through another revolution of the blade assembly 20 to be reshredded at the stator 22.

As best shown in FIG. 3, the auger 24 is mounted on the driveshaft 100 directly adjacent and downstream from the blade assembly 20. The auger includes an auger blade 146 formed in a continuous helical shape. The auger blade 146 is separated from the inside of the cylindrical housing by a narrow gap 147. The auger 24 receives shredded insulation from the blade assembly 20 and rotates about the axis 21 to move the insulation in the flow direction 23 toward the housing outlet 26. The auger 24 lightly compacts the shredded insulation while moving the insulation.

The shredded insulation is discharged from the apparatus 10 at the housing outlet 26. As shown in FIG. 1, a bag 148 (or other receptacle) may be positioned at the outlet 26 to receive the insulation. The bag 148 may be secured around the cylindrical housing 28 adjacent the outlet 26 by a rubber band 150, or the like. In this way, the shredded insulation may be packaged at the construction site. Since the shredding apparatus 10 does not rely on air flow to urge the shredded insulation from the housing, the bag 148 may be impermeable to air.

To mount the driveshaft 100 (with the blade assembly 20 and auger 24 mounted thereon) within the cylindrical housing 28, the shaft 100 may be inserted through the housing outlet 26. The first shaft end 103 is received through a shaft aperture 135 in the first end plate 36 (see FIG. 3). A shaft bearing ring 136 receives and rotatably supports the first shaft end. The shaft bearing ring 136 has a peripheral flange 138 that is rigidly bolted to the exterior of the first end plate 36.

The second driveshaft end 104 is rotatably attached to a vertical support bar 140 that is fixed within the cylindrical housing 28 adjacent the auger 24. The support bar 140 is fixed within the cylindrical housing by pairs of bolts 142 passing respectively through the top and bottom of the cylindrical housing 28. The driveshaft second end 104 has a cylindrical bearing cavity 143 that receives a cylindrical bearing stud 144 that extends from the center of the shaft support bar 140.

As best shown in FIGS. 1 and 2, a drive motor 152 powers the driveshaft 100 to rotate the blade assembly 20 and auger 24. The drive motor 152 is mounted upon a lower shelf 154 of the frame 12. A drive pulley 156 mounts upon a horizontal drive motor shaft 157. A driveshaft pulley 160 mounts on the driveshaft first end 103 in planar registration with the drive pulley 156. A single drive belt 162 connects the drive pulley 156 and driveshaft pulley 160 to rotate the driveshaft 100. As shown in FIG. 3, a removable guard 163 covers the belt, chain and pulleys associated with the feed and drive motors.

Example

In a preferred embodiment, the feed motor 90 is a single-phased, 220-volt, one-sixth horsepower "Maxi Torq Premium" motor made by Dayton Motors Company. The feed pulley 92 and roller pulleys **94*a*, 94*b* are sized for a three-to-one mechanical gear reduction. The feed motor 90 is preferably run at 30 rpm to counter-rotate the rollers 60*a*, 60*b*** at a rate of 10 rpm. Other feed motor types, roller sizes and roller counter-rotation speeds may also work equally as well.

The knife blades 114 are Kondex Company 573BB3R1 half-section knives. Forty-two blades are mounted on the blade tube 108, with 21 blades in each helical pattern. The blades 114 have a longitudinal spacing of about 1.5 inches along the blade tube 108. Other kinds of blades, blade patterns, numbers of blades, and blade spacing may work equally as well. For instance, a single helical pattern of blades 114 may be used.

The auger blade 146 preferably is about 0.25 inch thick, with about a 12-inch outer diameter and an 8.5-inch pitch. The auger blade 146 is welded to the driveshaft 100, which preferably has an outer diameter of about 2.875 inches. Various other auger pitches and blade types will work equally as well.

The drive motor 152 is a single-phase, 220-volt, three-horsepower "UC Motor Series 2000" motor made by the WEG Company. The drive motor has a five-tone ratio reduction gear box, and the pulleys 157, 160 have a one-to-one mechanical ratio. The drive motor 152 rotates at 1,750 rpm to rotate the driveshaft at about 350 rpm. Various other drive motor types, motor speeds and pulley sizes may be used with equally good results.

The drive motor 152 and pulley motor 90 are both controlled by a single switch on control box 164 to run at the preselected speeds (see FIG. 1).

This exemplary shredding apparatus generally shreds insulation into 1- to 2-inch-diameter pieces. The resulting mean size is adjustable. For instance, the mean size may be increased by wider spacing of the knife blades 114, and by reversal of the preferred blade offset angle. The control box 164 could also be equipped to selectively vary the motor speeds which could permit insulation to be shredded in customized sizes.

The shredding apparatus may be used to shred scrap insulation at a construction site, a centralized reprocessing site where scrap insulation is collected, an insulation factory, or other sites.

Having illustrated and described the principles of the invention in a preferred embodiment, it should be apparent to those skilled in the art that the invention can be modified in arrangement and detail without departing from the such principles. I claim all modifications coming within the spirit and scope of the following claims.

I claim:

1. A machine for shredding material, comprising:

a housing having an inlet for the material;

a blade assembly positioned within the housing adjacent the inlet, the blade assembly being rotatable about an axis defining a flow direction for the material, whereby rotation of the blade assembly induces material fed through the inlet to the housing to flow along the axis towards one end of the blade assembly, the blade assembly having a plurality of generally radially extending knife blades arranged in a helix about the axis, the knife blades each being relatively planar and having a leading cutting edge and a trailing edge, each of the knife blades being disposed generally transversely to the axis but being rotated about a radial line drawn from the axis through the blade such that the cutting edge of the blade is positioned relatively further toward the one end of the blade assembly than is the trailing edge thereof, the blade assembly being operable to catch the material fed into the housing and move it in the flow direction, the rotated trailing edges of the knife blades serving to decrease the speed of movement of the material in the flow direction; and an obstruction member connected to the housing adjacent the blade assembly, the obstruction member comprising a fixed member having fingers interdigitated with the blades of the blade assembly, the obstruction member obstructing the insulation caught on the rotating blade assembly, whereby the blades shred the material.

2. A machine according to claim 1, wherein each of the knife blades is rotated about ten degrees about the radial line.

* * * * *